United States Patent [19]

Tuten et al.

[11] Patent Number: 4,499,984

[45] Date of Patent: Feb. 19, 1985

[54] SELECTIVE SCRAP METAL COLLECTION APPARATUS

[75] Inventors: William J. Tuten, Scottsdale; Kennith D. Crosby, Carefree, both of Ariz.

[73] Assignee: Creative Technology Corp., Scottsdale, Ariz.

[21] Appl. No.: 463,573

[22] Filed: Feb. 3, 1983

[51] Int. Cl.[3] ..... G07F 7/06

[52] U.S. Cl. ..... 194/4 C; 177/165; 100/902

[58] Field of Search ..... 194/4 C, 4 R; 100/902; 209/629, 631; 177/165; 414/21; 73/1 B

[56] References Cited

U.S. PATENT DOCUMENTS 4,402,391 9/1983 Tuten et al. ..... 177/165 X 4,418,773 12/1983 Finet et al. ..... 177/165 X

*Primary Examiner*—Stanley H. Tollberg

*Attorney, Agent, or Firm*—Harry M. Weiss; Bill Holloway

[57] ABSTRACT

An unmanned apparatus for collecting scrap aluminum cans and for compensating depositors based on the weight of such cans deposited includes a micro-processor control means which produces control signals for operating the apparatus and dispensing compensation, calibrating a weighing means, monitoring and displaying the existence of alarm conditions and de-energizing the apparatus until the conditions which caused the alarm are corrected. Further, a communication port is provided to transmit and receive remote information as for example from a central dispatch. The compensation and the rate thereof is controlled by a permanent non-volatile memory means and the weight of the cans upon which compensation is based is displayed to the depositor.

25 Claims, 20 Drawing Figures

SELECTIVE SCRAP METAL COLLECTION APPARATUS

BACKGROUND OF THE INVENTION

1. Field of the Invention

This invention relates generally to apparatus for selectively recovering or collecting scrap metal of a given type such as aluminum containers and for compensating depositors of such scrap based on the weight of the metal so collected.

2. Description of the Prior Art

Systems for selectively collecting scrap metal are well known, and U.S. Pat. Nos. 4,179,018 and 4,257,511 issued to John H. Miller are exemplary.

These patents disclose apparatus in which non-returnable aluminum cans such as are used to package soft drinks and malt cereal beverages are segregated from other material such as tin plated steel cans that may be deposited in the apparatus. A start button or switch is pushed by the depositor to start the operation of the apparatus. The deposited materials are conveyed by a conveyor belt to a magnetic separation portion of the apparatus which separates magnetic, ferrous materials such as tin plated steel cans from non-magnetic materials and stores the ferrous materials in a storage bin. However, non-magnetic materials are collected at the bottom of a pneumatic classifier conveyor which transports the aluminum, non-ferrous metal container to a crusher. The materials so transported are crushed and weighed. After weighing, the crushed aluminum is conveyed by a pneumatic stacker conveyor and deposited into an inclined storage location at the top of the apparatus.

The apparatus is provided with a compensation dispenser which dispenses coins, tokens, or other symbols of value, the amount or value of which is determined by the weight of the non-ferrous materials that pass through the crusher and are weighed by the weighing means during operation of the collection apparatus.

This type of apparatus is designed to be unattended and is frequently placed in parking lots of shopping centers where it is easy for persons who patronize the retail stores to dispose of cans.

The recovered aluminum from this source saves energy and raw materials while simultaneously reducing the problems associated with the disposing of such cans after their contents have been consumed. While the present price of tin plated steel cans makes it almost impossible to compensate for them, their collection is of some intrinsic value insofar as cleaning up the environment is concerned. Notwithstanding, a depositor is notified that he will not be compensated for a tin plated steel can.

In copending application Ser. No. 211,739 filed Dec. 1, 1980, now U.S. Pat. No. 4,402,391, issued Sept. 6, 1983, there is described an improved metal collection apparatus for collecting selected metals such as aluminum. The apparatus includes means for detecting false jams, improved compensation means, and better diagnostics through the use of a smart digital controller. The teachings of this application are hereby incorporated by reference. Unfortunately, the apparatus disclosed has several drawbacks. First, field results have indicated that the present apparatus does not adequately weigh the deposited material. It has been shown that under the best of conditions, the present apparatus will weigh to an accuracy of no greater than 95%; however, many weights and measure codes require a greater accuracy (i.e. at least 98%). Furthermore, field failure of the scale dump solenoid had resulted in failure to compensate a depositor for cans deposited. The existing systems require a great deal of service and maintenance, and their throughput has been somewhat limited. Furthermore, these existing systems do not permit the addition of new features without changing the components within the existing controller.

Untrained service personnel tend to operate the system in such a manner as to damage the solid state relays, and there is a tendency on their part to calibrate the system even when such calibration is not required. In the existing system, there is no mechanism for insuring that the pay out equals the advertised price per pound.

SUMMARY OF THE INVENTION

It is an object of the present invention to provide an improved selective scrap metal collection apparatus.

It is a further object of the present invention to provide a selective scrap metal collection apparatus having greater accuracy.

It is a still further object of the present invention to provide a selective scrap metal collection apparatus having increased throughput.

Yet another object of the present invention is to provide a selective scrap metal collection apparatus which includes greater control of the dumping solenoid.

It is a further object of the present invention to provide a selective scrap metal collection apparatus which requires reduced service and maintenance, is characterized by easy adaptability to new features, and which includes an improved alarm system and diagnostics.

According to a broad aspect of the invention there is provided a collection apparatus for collecting scrap metal and for compensating depositors for a first type of metal as a function of the weight of the first type of metal deposited in a storage compartment of the apparatus, said apparatus having an input hopper, a start button, a first conveyor for conveying scrap metal from the hopper to a classifier, said classifier segregating a second type of metal from the first type, depositing the second type of metal in a metal receptacle and for depositing the first type of metal in a classifier conveyor, said classifier conveyor transporting the first type of metal to and loading said metal into a crusher, said crusher crushing the first type of metal and loading it into a weigher bucket of a weigher which measures the weight of the weigher bucket and its contents, said bucket having a door which is controlled by a scale dump solenoid for empting the bucket after weighing, a stacker for conveying the first type of metal after it has been weighed to a storage compartment, an alarm display and means for producing motor alarms, second type metal alarms, classifier jam alarms and dispenser alarms, the improvement comprising:

a digital electronic controller responsive to a signal from the start button for energizing the first conveyor, the classifier, the crusher and the stacker, for calibrating the weigher, for weighing materials dumped in the bucket of the weigher, for monitoring the bucket to assure that the scaled dump solenoid has opened the door thereto, for causing a reference voltage to be generated which represents a measure of substantially one pound to be used in the weighing process, for dumping the materials from the hopper into the stacker for storage in the compartment, for dispensing compensation for the material weighed, and for stopping operation when there are no more cans to be processed;

a communication port for conveying and receiving remote information; and front panel display means for indicating the weight of said first type of metal deposited.

According to a further aspect of the invention there is provided the collection apparatus for collecting scrap metal of a given type and for compensating depositors of said scrap metal of said given type based on the weight of said scrap metal deposited, comprising:

first means adapted to receive scrap metal including metal of said given type;

classifier means for classifying and separating said scrap metal of a given type from other scrap metal, for depositing scrap metal which is not of said given type in a first receptacle and for depositing scrap metal of said given type into a classifier;

a first conveyor having a first conveyor motor for transporting scrap metal deposited in said first means to said classifier;

a crusher powered by a crusher motor for crushing scrap metal;

a classifier conveyor for transporting scrap metal of said given type to said crusher;

a weigher having a bucket for weighing material deposited in said bucket, said weigher being positioned so that material passing through the crusher is deposited in the bucket, said weigher including means for producing electrical signals which are a function of the weight of the hopper and of material placed in the hopper from the crusher;

means for dumping the contents of the hopper in response to a dump control signal to a door of said hopper;

a storage compartment for said metal of said given type;

a stacker for conveying crushed metal of said given type when dumped from said hopper to the storage compartment for storage in said compartment;

a coin dispenser responsive to control signals for dispensing compensation to the depositor and for producing an alarm signal identifying the absence of the coins to be dispensed and a jam of the dispenser;

a front panel display for informing said depositor of the weight of the metal of said first type deposited;

means for producing an alarm signal if any motors of the apparatus are energized and are not operating properly;

means for producing an alarm signal if metal is deposited in the first receptacle and if the first receptacle is full;

means for producing an alarm signal if the classifier conveyor is jammed;

control means for producing control signals for energizing the motors, for calibrating the weighing system, for dumping the hopper, for determining the weight of the first type of metal deposited in the storage compartment and the amount of compensation to be paid therefore, and for producing control signals to control the dispenser of compensation, said control means sensing any alarm signals produced and responsive to any such alarm signals for energizing the alarm and the out of order display for de-energizing the apparatus if the condition causing an alarm signal persists for more than a pre-determined period of time, for sequencing the operation of the motors, and for determining if the scale dump solenoid has been activated to empty the hopper; and a communication port coupled to said control means for conveying and receiving remote information.

According to a still further aspect of the invention there is provided a method of controlling a collection apparatus which collects aluminum cans and for compensating a depositor thereof as a function of the weight of the aluminum cans deposited in a storage compartment of the apparatus, said apparatus having an input means, a start button, a first conveyor for conveying material from the input means to a classifier, said classifier segregating ferrous metal from non-ferrous metal, depositing ferrous metal in a ferrous metal receptacle and for depositing aluminum cans in a classifier conveyor; said classifier conveyor for transporting aluminum cans to a crusher and loading said cans into said crusher, said crusher for crushing the aluminum cans and loading crushed cans into a weigher bucket of a weighing apparatus which measures the weight of the bucket and the crushed aluminum cans in said bucket; a stacker for conveying the crushed aluminum cans after being weighed and dumping them into a storage compartment, the method comprising:

sensing when the start button is pushed;

energizing said first conveyor, classifier, crusher, and stacker;

calibrating said weigher;

determining the weight of materials dumped in the bucket of said weigher;

dispensing compensation based on the weight of aluminum cans in the bucket;

storing the compensation rate in a permanent non-volatile memory means; and informing said depositor of the weight upon which compensation is based.

The present invention provides an improved metal collection apparatus for collecting selective metals such as aluminum primarily in the form of used aluminum cans and for compensating depositors of such metal cans based on the weight of the selected metal collected. The collecting apparatus is free-standing and is designed to function unattended. The apparatus is provided with a hopper into which depositors place material, aluminum cans, which the machine is designed to collect. The depositor then pushes a start button in the vicinity of the hopper to initiate operation of the apparatus. The deposited material is carried from the hopper to a classifier by means of an endless conveyor belt. The classifier segregates magnetic or ferrous material from non-magnetic materials.

A pneumatic conveyor carries aluminum cans to a crusher. The more dense non-magnetic materials collect in the bottom of a bin provided in the pneumatic conveyor. The aluminum material is conveyed by the conveyor of the classifier to a crusher where the material is crushed so as to be more compact and occupy significantly less space when stored. After passing through the crusher, the crushed material is weighed and its weight noted. The crushed material is then dumped into a stacked conveyor which transports the crushed aluminum cans to a storage bin in which they are stored until forwarded to a recycling plant.

A digital electronic collector is provided to control the enerization of the motors that drive the conveyors and the crusher and provide power to the classifier. The weigher produces an analog signal that is digitized by an analog-to-digital converter. The controller, based on the difference in readings from the analog-to-digital converter, causes the compensation dispenser to dispense an appropriate amount of compensation in the form of coins or tokens. The apparatus is provided with motor alarm circuits which produce an alarm signal if any one of the motors is not running properly when energized. The coin dispensing apparatus will produce alarm signals if no coins or tokens are available to be dispensed.

A detector is provided which produces an alarm signal each time a piece of magnetic material, such as a steel can, is segregated from the materials deposited. An alarm will also be produced when the container or receptacle which receives these materials is full. Another detector is provided which produces an alarm signal if a jam occurs in the classifier conveyor since such a jam will prevent aluminum cans from being fed to the crusher. The electronic controller also includes circuit means for automatic calibration of the weighing system which is used to measure the weight of the aluminum cans deposited therein to assure that it is accurately weighing the material dumped.

The digital electronic controller adjusts the set gain of the system such that the output of the weighing system is well within the range of the analog-to-digital converter. The autocalibration is updated continuously between cycles which results in optimum performance of the weighing system. In addition to this calibration, the load cell is initialized with a load-to-voltage out resistor. Thus, replacement of the load cell or the controller, changes in temperature, or variation in the power supply will not affect system accuracy. In addition to the above features, the system is designed to reduce service in the field to an absolute minimum. Built in test features allows for easy and rapid troubleshooting.

The inventive system has an improved cycle time which is accompanied by increasing the weight of the bucket before stopping from 0.75 lbs. to 1.5 lbs. Thus, the throughput of the apparatus is increased from 150–200 lbs. per hour to 300–400 lbs per hour.

To facilitate service and operation, retest features are incorporated which periodically recheck all failed conditions. Should a failed or fault condition be cleared, the apparatus is placed back in operation.

As stated previously, the existing systems are incapable of detecting operation of the scale-dump solenoid. The controller of the present invention uses its knowledge of weight to detect whether the scale door opened.

Other features incorporated in the inventive collection apparatus relate to security of the money payout. In present systems, the compensation rate is set by thumbwheel switches. In the inventive apparatus, the compensation is preset into a non-volatile memory. This memory provides an account of money and poundage and remembers such quantities even if power fails or is turned off.

All solid state output devices are now protected by short circuit protection circuitry. In this manner, destruction of the driver devices is prevented when the output is inadvertently short circuited.

The inventive system incorporates a method which permits the accuracy to be increased to an error rate of less than one percent on compensation. This is accomplished by altering the sequence of operation and by utilizing an improved bucket arrangement.

The above and other objects, features and advantages of the present invention will be more clearly understood from the following more detailed description taken in conjunction with the accompanying drawings, in which:

DESCRIPTION OF THE PREFERRED EMBODIMENT

Figure 1:
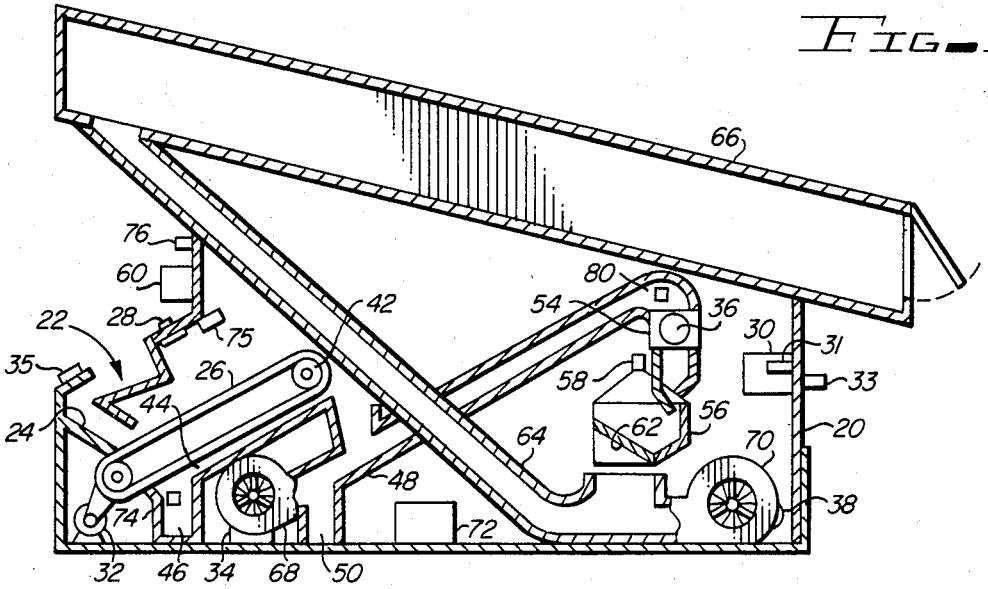
FIG. 1 is a side cross-sectional view of the inventive collection apparatus.

FIG. 1 illustrates a collection apparatus 20 which is an improvement over that describing U.S. Pat. No. 4,179,018 issued Dec. 8, 1979, the teachings of which are hereby incorporated by reference. Collection apparatus 20 is freestanding and may be located in public places such as the parking lots of shopping centers.

The depositer pushes start button 28 which initializes controller 30 and starts the operation of collector apparatus 20. The depositor who has collected a supply of used aluminum cans or aluminum scrap, in any form, particularly of a gauge not too significantly thicker than that of aluminum cans, then deposits such waste material in hopper 22. The material falls down shoot 24 until it contacts the upper surface of endless conveyor belt 26. Controller 30, which is a digital electronic controller, to be described in more detail below, causes belt conveyor motor 32, classifier motor 34, crusher motor 36 and blower motor 38 to be energized with electrical energy. Conveyor belt 26 transports the material deposited into it to magnetic separator 42 which cooperates with the upper end of conveyor belt 26 to separate out ferrous material. Ferrous materials such as tin plated steel cans will fall down through chute 44 and will be collected in ferrous metal receptacle 46. Non-ferrous metals such as aluminum containers or cans are discharged into the entrance of pneumatic classifier conveyor 48. Denser non-magnetic waste material, substantially more dense than aluminum cans, fall into and collect in receptacle 50 which is located under conveyor 48. Aluminum cans or containers are conveyed upwardly by the pneumatic classifier conveyor 48 and are discharged into crusher 54. After being crushed, the aluminum cans are discharged into weighing hopper or bucket 56.

The weight of the material in bucket 56 is measured by conventional load cell 58 that has previously been specifically adjusted for accurate weight under all conditions. The voltage difference produced by the load cell, which is an analog voltage, is digitized as will be described hereinbelow and is applied to controller 30. The difference analog voltage is used in three ways. First, the known weight of the sample circuit produces an analog voltage that is used to establish an exact reference for the system thereby eliminating drift to system components. Second, the empty weight is determined to be the existing bucket 56 weight. Third, once in the cycle the difference between the empty weight and the present weight is the can weight. When the can weight reaches 1.5 lbs. or a time out period of, for example, 30 seconds has been reached, the conveyor 26 and crusher 54 stop. The weight in the bucket 56 is weighed once more and then the bucket 56 is dumped. After a sufficient delay, the contents of bucket 56 being conveyed by the blower motor 38 falls out of the bucket 56 and the empty bucket weight is measured. The difference in weight is used to calculate the compensation which is dispensed by the compensation dispenser 60. Compensation is in the form of coins, tokens, etc. The contents of the bucket 56 are dumped by energizing a solenoid to open doors 62 of the bucket 56.

The crushed non-ferrous metal from bucket 56 falls into the pneumatic blower conveyor 64 which transports the crushed aluminum material to storage compartment 66 where the aluminum is collected and stored until a sufficient load is collected. The load is then dumped into a truck, for example, and taken to a facility where the scrap metal can be recycled. Controller 30 controls the energization of the conveyor motor 32, classifier motor 34 which drives blower 68, blower motor 38 which drives blower 70, and crusher motor 36 which provides the energy for crusher 54. In addition, controller 30 produces control signals which cause compensation dispenser 60 to dispense quarters, nickels, pennies, and tokens in the preferred embodiment. A multi-hopper dispenser such as the one designated as model 32-22-000 which is manufactured by National Rejectors Inc. (Division of UMC Ind. Inc.), of Hot Springs, Ark., may be utilized as compensation dispenser 60. Collector 20 is provided with an out-of-order display 72 which identifies the function that is out of order as sensed by controller 30. Out-of-order display 72 is positioned within the housing of apparatus 20.

Controller 30 is provided with a sampling circuit to sample the load cell 58 so as to make certain that an accurate weight is made by electronic components which change their values in accordance with the environment. Since the load cell has been previously adjusted to provide an exact analog signal equivalent to exactly one pound, an exact weight can always be realized independent of the temperature, humidity, etc. of the electronic components. Controller 30 also senses any alarm signals produced as a result of a motor failure. Coin dispenser 60 is provided with means for producing alarm signals if no coins are available to be dispensed or if dispenser 60 is jammed. In addition, one of the major causes of problems with the prior art collectors of the type disclosed in U.S. Pat. No. 4,179,018, is that ferrous metal receptacle 46 becomes filled creating a jam, which renders apparatus 20 inoperative. A conventional electro-magnetic infrared radiation detector 74 is mounted at the upper end of receptacle 46. Each time a can of ferrous metal, for example, falls into receptacle 46, it will break or enter the light beam across the entrance to receptacle 46. The breaking of the beam is evidence that a tin plated steel can, for example, was deposited in hopper 22. The breaking of the light beam produces an alarm signal which causes buzzer 75 to produce an audible tone that indicates to the depositer that a ferrous metal can has been processed. If the signal is continuous, (i.e. the beam of electromagnetic energy at the entrance to receptacle 46 remains broken for a substantial period of time such as 30 seconds) receptacle 46 is full which is cause for a second alarm signal.

A second electromagnetic detector 80 is mounted in the discharge nozzle classifier conveyor 48 to sense that a jam has occurred. If a jam is sensed by detector 80, controller 30 prevents additional cans from being fed into crusher 54. Controller 30 also produces a control signal which energizes a solenoid (not shown in FIG. 1) to open door 62 on bucket 56 after the contents of the bucket 56 has been weighed. Controller 30 also calculates the weight of the material dumped into conveyor 64 from the digitized voltage difference from load cell 58 by comparing the weight of the weighing bucket 56 after dumping its contents with the weight of bucket 56 and its contents immediately prior to dumping. Based on the weight of the material dumped from bucket 56, controller 30 calculates a compensation due the depositor and energizes the appropriate coin dispenser of compensation dispenser 60 to provide the computed amount of compensation.

Systems are provided which produce alarm signals which, when applied to controller 30, cause controller 30 to light appropriate signal lights on out-of-order display 72 so as to identify the cause of failure. For certain types of failures, controller 30 is programmed to respond by re-energizing the component which was a source of the alarm signal to see if the problem could be cleared or corrected, and if the problem is not corrected, controller 30 would de-energize all the motors and provide a signal at status signal light 76 indicating to depositors the apparatus 20 is non-operational.

Incorporated into controller 30 is a communication port 31 which allows the controller to relay an appropriate signal indicating that a de-energized inactivated apparatus 20 is out of order. Such a signal could be sent to a central office by radio or telephone so that service personnel could be promptly dispatched. Diagnostic information is also available via this link to allow the service man to understand the problem before he reaches the site and thereby permit him to bring adequate spare parts if needed. This practice also allows a central office to monitor to amount of aluminum taken in such that pickup of the material only occurs as needed.

Figure 17:
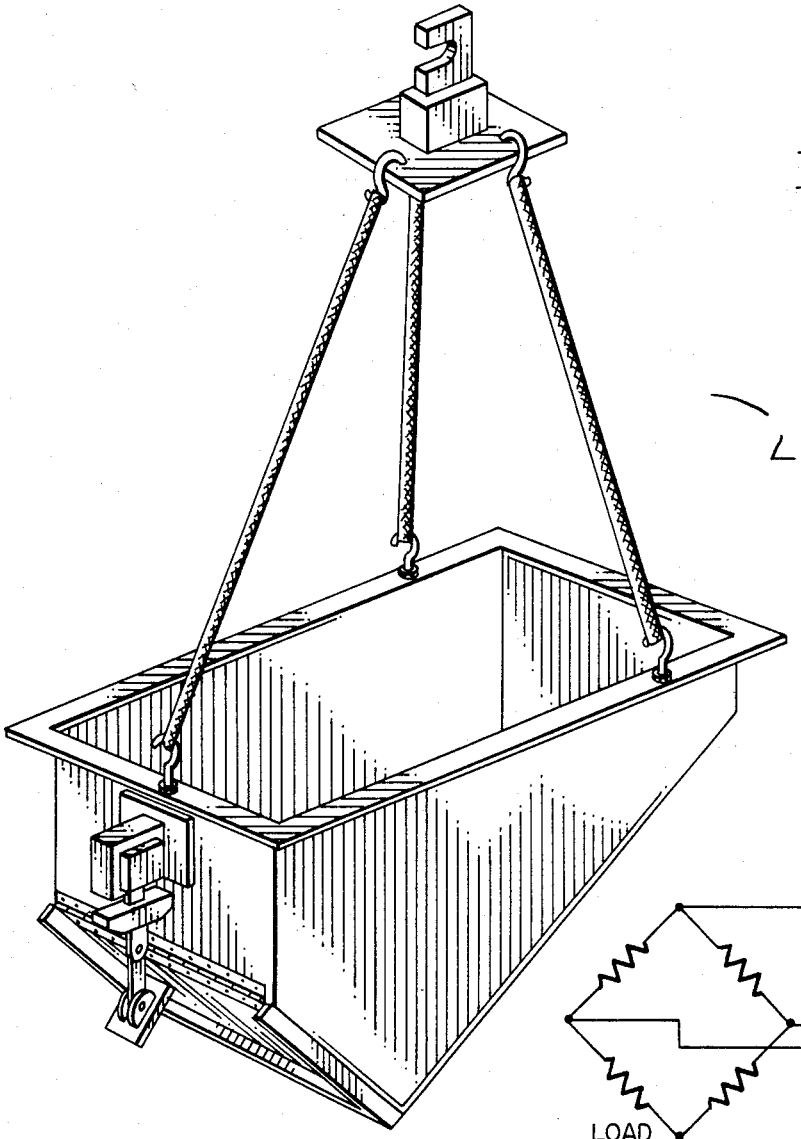
FIG. 17 illustrates an improved bucket arrangement using three straps.

As was stated previously, the inventive collecting apparatus has a significantly improved accuracy. This has been accomplished by straping bucket 56 which three straps as is shown in FIG. 17 instead of four straps. This prevents bucket 56 from twisting and rubbing and therefore a more uniform analog weight signal is produced. Additionally, it was found that the crusher motor, if stopped, reduces vibration to further improve accuracy. It also prevents late falling cans from effecting the measured weight. It was also found that the apparatus operates far better when mounted firmly to a concrete base. Additionally, an increase in the width of the crusher plate and additionally ducting in the crusher discharge area will prevent loss of material falling into the weight hopper. The problems and inaccuracies caused by cans dropping to the floor at the crusher plate and crusher discharge area are thus significantly reduced.

To alleviate problems associated with failure of the scale dump solenoid, controller 30, which knows what weight of material has been received, uses this information to determine that the solenoid has opened bucket door 62. Should door 62 not open, controller 30 determines that the weight did not change and thus it will shut the system down after it has properly compensated the depositor for all material already received.

To reduce service time and maintenance, all inputs are separately monitored. All boards are easily removed and a self test feature has been added. A method has also been added to allow individual motors and other functions to be activated by the controllers.

As already stated, the throughput of the improved apparatus has been increased from 150–200 pounds per hour to 300–400 pounds per hour. Further, controller 30 may be equipped with additional features without changing the internal components. These features are added via an external connector 33 to communication port 31. The alarm system now includes features which make it possible to track cans as they go through the apparatus, and diagnostics have been incorporated to test all motor, light, controller components and the solenoid. These tests are entered via a small keyboard inside controller 30.

To prevent damage caused by unskilled personnel during maintenance, a larger solid state relay specifically designed for this application has been used in conjunction with a fuse, for example, a 4-ampere fuse which will blow before, for example, a 30-ampere triac with a surge capability of 300 amperes. The fuse will always blow before the triac. As an additional improvement, controller 30 reads the analog weight voltage during times when it is not in use and automatically adjusts the system such that it is in the center of the range of operation for the weighing system. This is accomplished automatically without adjusting potentiometers.

Control of the weight and the amount paid is now accomplished electronically by means of a permanent non-volatile memory. Information required to control pay-out, weight amount and rate is stored in this memory. The compensation rate must now be set by a special operator using a special input device. This improvement eliminates possible pay-out problems and, in addition, the pounds of aluminum received from the customer will be displayed at the input hopper using an electronic display module 35. To further improve weighing resolution, a 13-bit analog-to-digital converter is used in place of the 12-bit analog-to-digital converter used in the above cited copending patent application.

Figure 2:
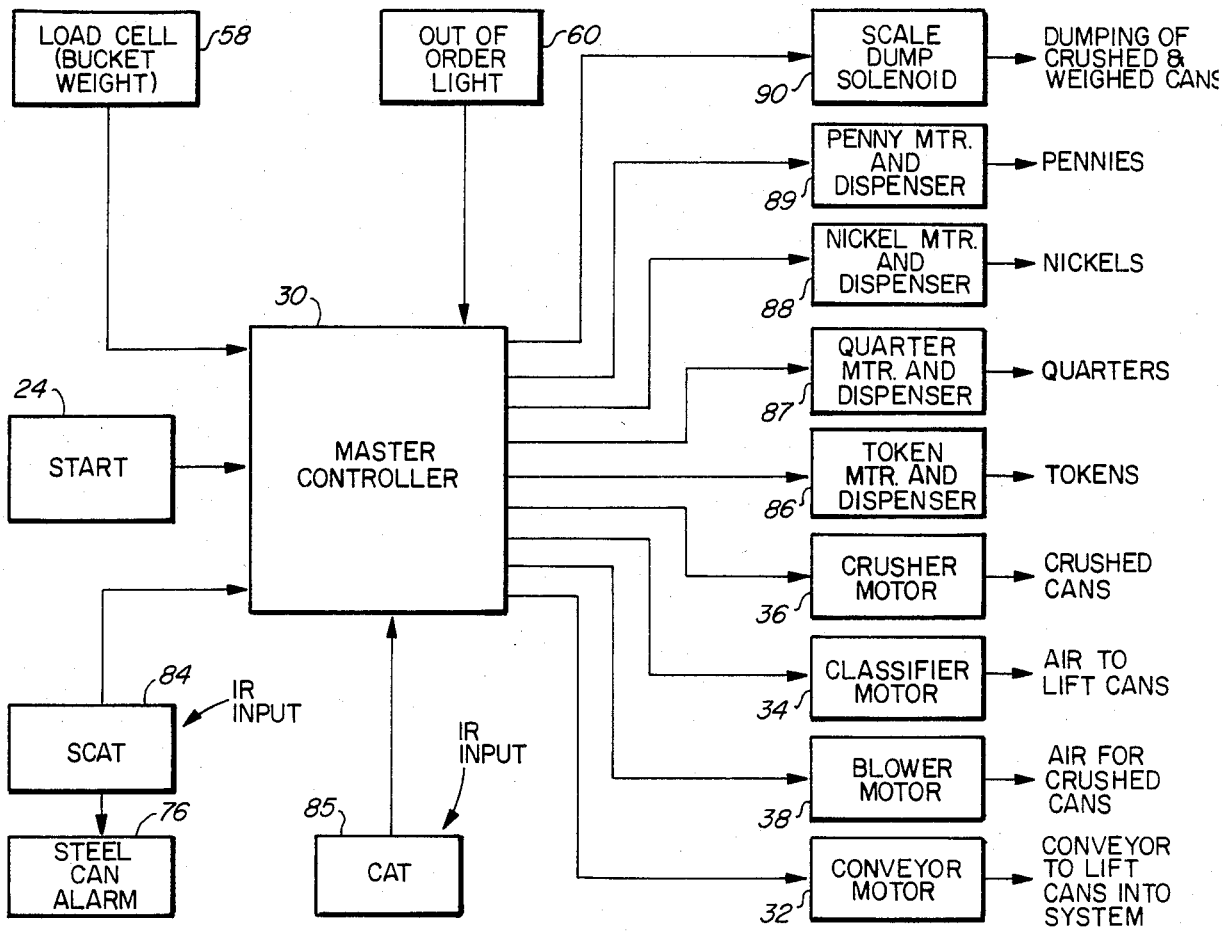
FIG. 2 is a functional block diagram of the improved selective scrap metal collection apparatus.

FIG. 2 is a functional block diagram of the control system for the improved selective scrap metal collection apparatus. The system consists of a master controller 30, a load cell 58, an out-of-order light 60, a start switch 24, a steel can alarm transmitter (SCAT) 84, a classifier alarm transmitter (CAT) 85, a steel can alarm 76, a scale dump solenoid 90, a penny motor and dispenser 89, a nickel motor and dispenser 88, a quarter motor and dispenser 87, a token motor and dispenser 86, a crusher motor 36, a classifier motor 34, a blower motor 38 and a conveyor motor 32. Controller 30 uses the inputs and outputs designated in FIG. 2 in order to monitor the collection apparatus shown in FIG. 1. The functions performed or the input received is so indicated in the drawing. For example, SCAT 84 and CAT 85 both receive their input from infrared beams.

Approximately eight seconds after start switch 24 is activated, the motors are sampled so as to ascertain if they are in operation. Should a motor not be operating, the system is determined to be out of order and will therefore be shut down, and the out-of-order light 60 will be turned on. While the motors are being started, controller 30 samples the load cell to determine what the analog value corresponding to one pound is under present conditions. This sample is equivalent to some analog voltage range. At the end of each sample the result is evaluated. When the analog signal is present, the controller executes a weight cycle. Should the analog voltage not be present after the third try, it is assumed that for some reason the sample is not available, the apparatus 20 is shut down, and the out-of-order light 60 turned on. Once the weight cycle is reached, controller 30 begins processing the analog data. First it reads the weight of the empty bucket. Then it searches for increased weight. When a weight of 1.5 pounds is reached, the controller stops the flow of cans by stopping the conveyor and the crusher motor, and after a settling down period, a final weight is made on the contents of the bucket. Bucket 56 is then dumped and an empty weight is taken. The difference between this empty weight and the bucket weight is the can weight upon which compensation is based.

A second possibility exists for arriving at the end of the weight cycle. This occurs when sufficient weight is not achieved within a specified period of time. At the end of each dump cycle, a decision is made as to whether the weight cycle needs to be repeated. This decision is based upon the measured can weight. If the weight, for example, exceeds 0.2 pounds, then the weighing cycle is continued. Otherwise, the controller 30 goes into a final payout cycle where remaining compensation is provided before the apparatus becomes inactivated.

Two other concurrent flows of informations and functions need be described. These relate to the coin dispenser and the steel can alarm. When a coin is dispensed, a detect signal is produced which is recognized by the contoller. Controller 30 then produces a drive signal to turn on a drum motor of the particular coin dispenser needing its tube refilled. Should the top detector remain on after a predetermined period of time (e.g. 15 seconds) the drum is stopped for one second. If, after a second predetermined period of time the top detector remains on, apparatus 20 will be shut down by the controller and the out-of-order light will be illuminated.

Each time the SCAT is activated by its IR beam being broken, it produces, for example, a one second audible sound alerting the depositor that he has put a tin plated steel can or other ferrous material into the apparatus. Should this beam be broken for longer than, for example 30 seconds, the apparatus will be shut off and the out-of-order light illuminated.

Once the controller 30 is in the alarm condition, it stops in this condition until the fault is cleared. The fault may not be real. To assure that the fault remains, controller 30 will evaluate the system, for example, every 15 minutes. If the fault clears, then the apparatus 20 will be ready for reactivation by a depositor.

Figure 3:
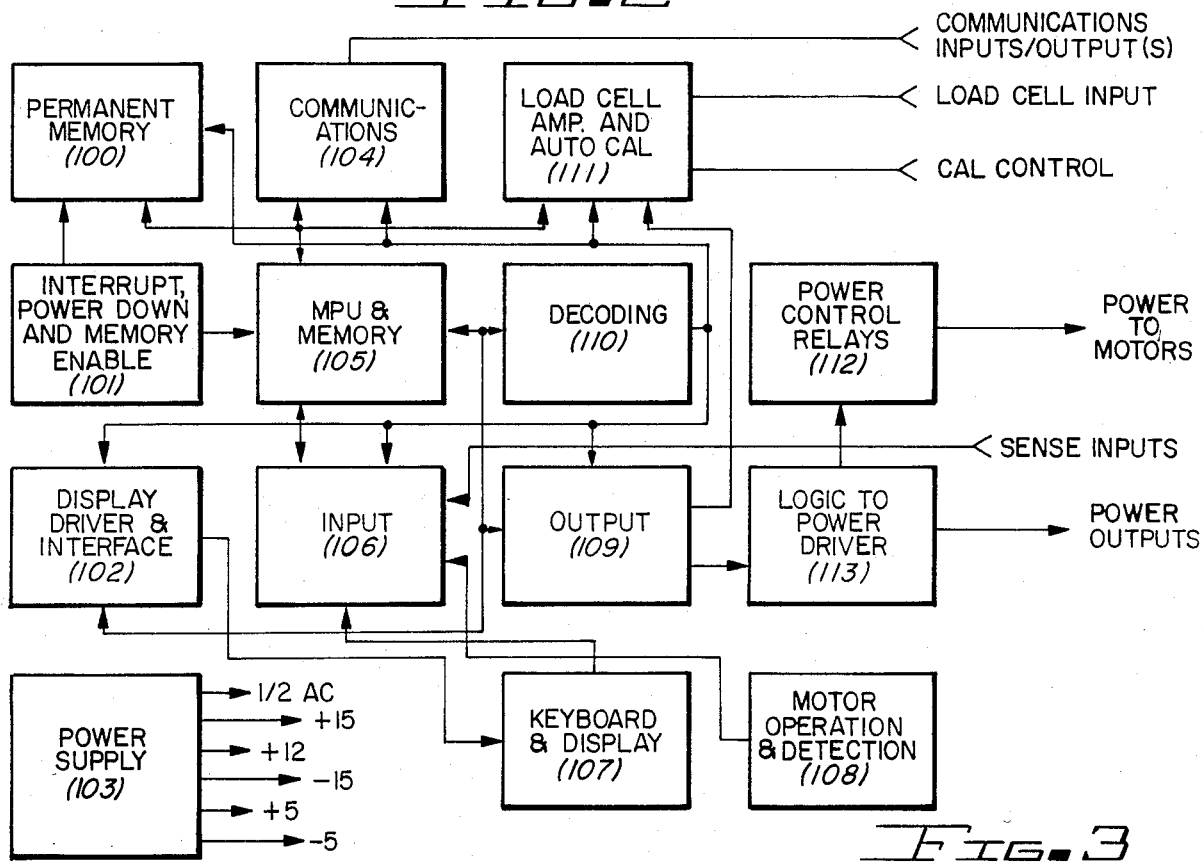
FIG. 3 is a block diagram of the master controller used in the inventive collection apparatus to provide the logic and analytical functions for the control system.

A block diagram of controller 30 is shown in FIG. 3. The heart of the controller is the MPU and memory section 105 which includes the program and provides the data base for system operation. It applies addresses to decoding section 110 which decodes the addresses so as to select a desired function of input/output or communications. All outputs with the exception of the display driver and interface section 102, the communications interface 104 and the permanent memory section 100, are routed through the output section 109. Outputs from the output section 109 are coupled to the logic which power driver section 113 and which select the analog-to-digital data in the load cell amplifier and automatic calibration section 111. Inputs from the keyboard and display section 107, the sense inputs and the motor operation and detection section 108 are read through the input section 106. The interrupt power down and memory enable section 101 provides the interrupt signals, the power down control and the enable signals for the permanent memory section 100. All power for the operation of controller 30 is provided by the power supply section 103. A power interrupter (contactor) is used to control the large power to the motor. This power control relay 112 is not shown on any of the other drawings. Each of the individual sections of the hardware are discussed in the following paragraphs.

Figure 4:
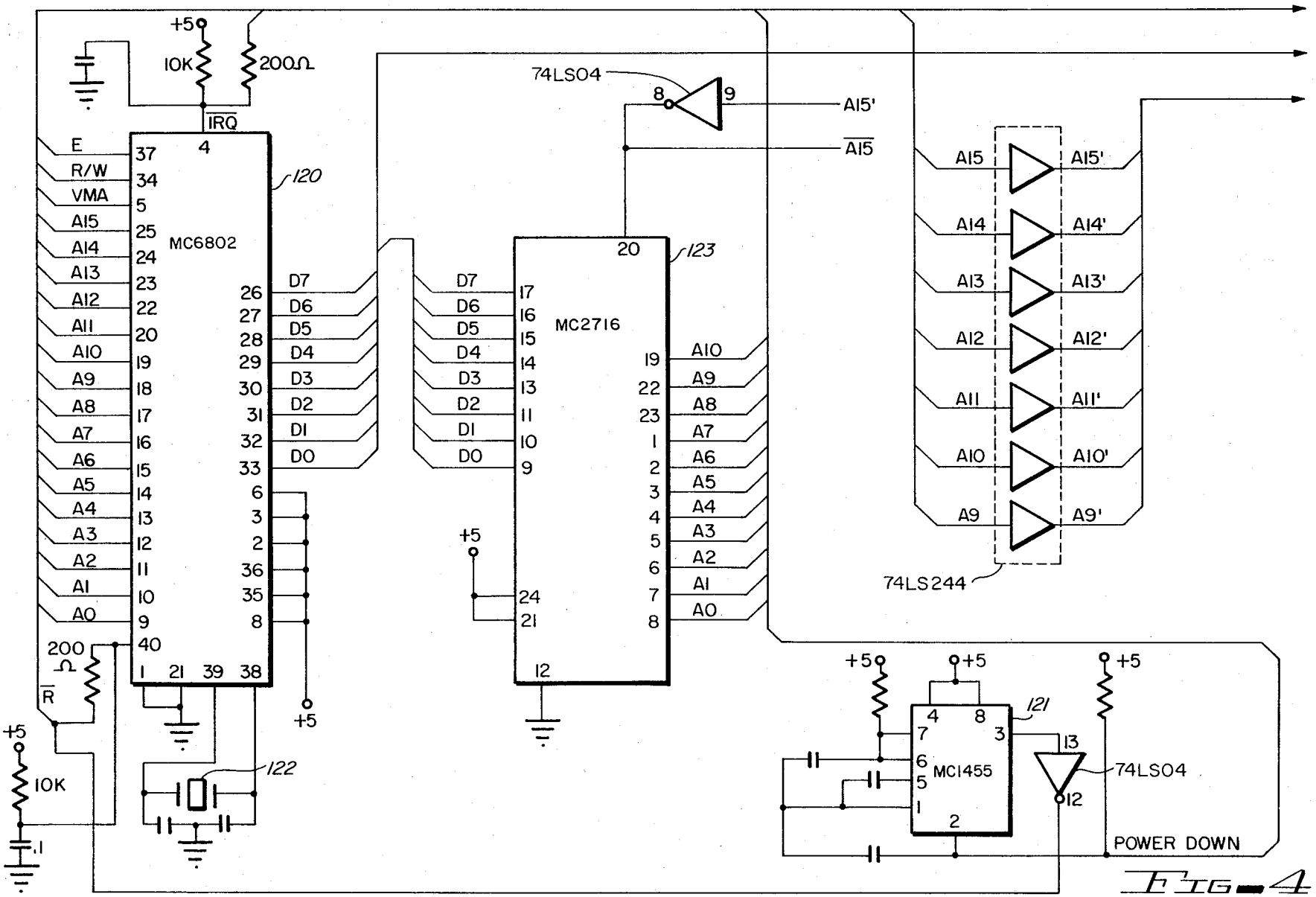
FIG. 4 is a schematic diagram of the microprocessor unit and memory section of the master controller.

FIG. 4 is a schematic diagram of the MPU memory section 105 and illustrates a microprocessor unit 120 (e.g. MC6802 available from Motorola Inc.). This circuit is initiated by a reset circuit 121 (e.g. Motorola part MC 1455) and is driven at a speed of approximately 800 kilohertz by a 3.579 megahertz crystal 122. It receives its program from a programmable read only memory 123 (e.g. a MC2716). Data and address bus information is provided to the other sections of the controller. The upper address lines A9–A15 are buffered by means of, for example, Motorola 74 LS 244 low power Schottky $T^2L$ devices.

Figures 5, 19A, 19B:
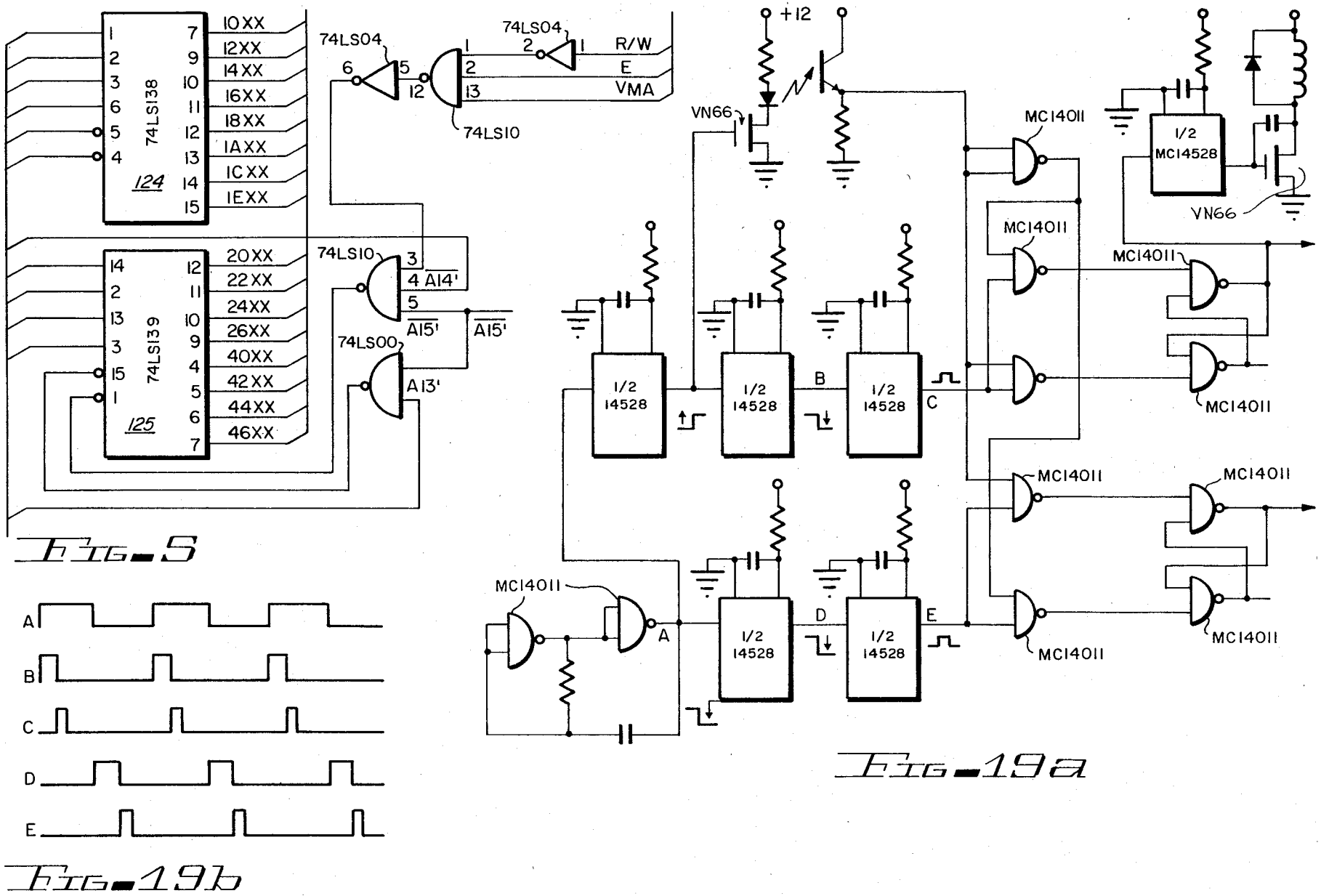
FIG. 5 is a schematic diagram of the decoding section of the master controller.
FIG. 19*a* is a schematic diagram of the steel can alarm and classifier alarm transmitter.
FIG. 19*b* shows pulses used in conjunction with the coupler of FIG. 19*a*.

The decoding section 110 is schematically shown in FIG. 5 and consists of a four-to-eight line decoder 124 (e.g. a 74LS138) and a second decoder at 125 (e.g. a 74LS139). The outputs of these decoders ascertain which device or section is to be addressed by microprocessing unit 120.

Figure 6:
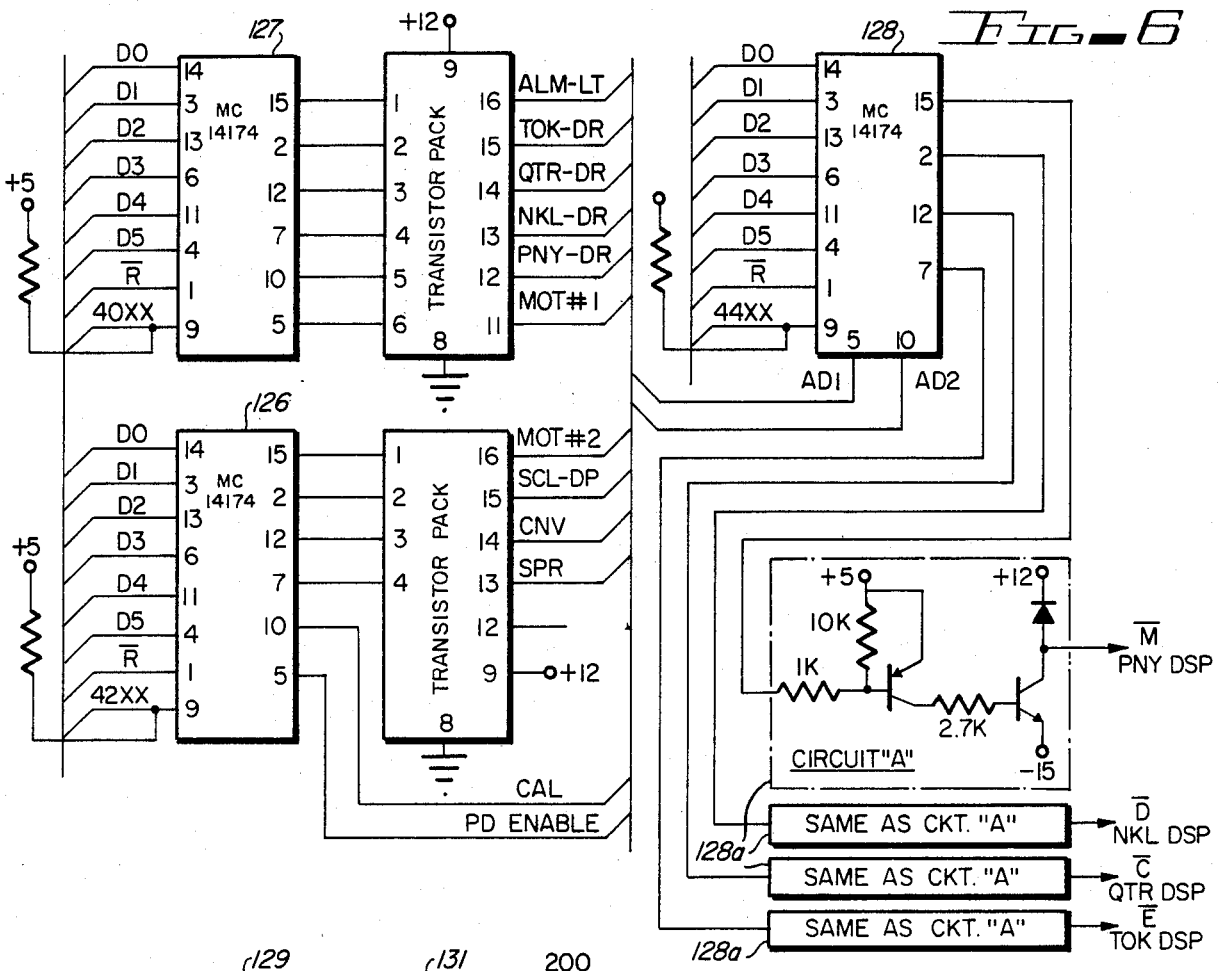
FIG. 6 is a schematic diagram of the output section of the master controller.

FIG. 6 illustrates the output section 109 of FIG. 1. When address data is stored in devices 126, 127 (e.g. each an MC14174) and device 128 (also an MC14174), it is remembered. The stored data remains in the stored state until it is removed via a reset, power down or another storage to the devices 126 and 127 or 128. The outputs of circuit 128 are coupled to driver circuits 128*a* which produce signals M, D, C, E which are forwarded to the penny dispenser, nickel dispenser, quarter dispenser and token dispenser, respectively.

Figure 7:
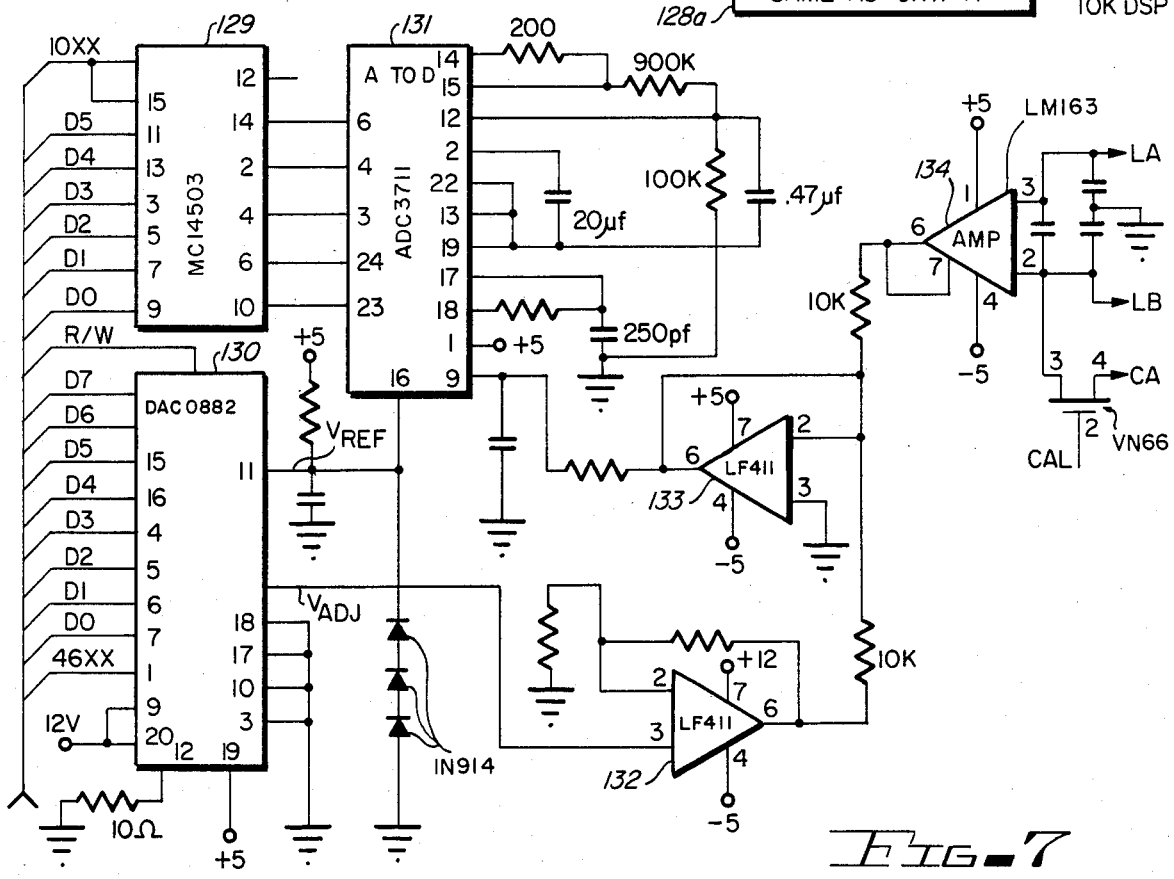
FIG. 7 is a schematic diagram of the load cell amplifier and autocalibration section of the master controller.

A schematic diagram of the load cell amplifier and autocalibration section 111 is shown in FIG. 7. Through the use of device 130 (for example a DAC 0882), an analog reference voltage is generated from a digital word. This voltage is presented to amplifier 132 (e.g. an LF 411) where it is inverted and divided by 3 before it is applied to one input of a summing amplifier 133 (e.g. an LF 411). The other input to the summing amplifier 133 is provided by the instrument amplifier 134 (LM 163). Its input is the normal offset voltage attributed to the normal bucket 56 weight via the analog signal from the load cell 58. The analog-to-digital converter device 131 (ADC 3711) is then used to read digitally the value of the output analog voltage summed by summing amplifier 133. The output of device 131 is presented to the microprocessing unit 120 where it is evaluated. When the output of the analog-to-digital device reaches a value of, for example, 150 plus or minus 100 millivolts, the autocalibration process of setting data at device 130 is concluded. This process is repeated every so often between uses of the apparatus. Thus, the controller 30 and apparatus 20 are kept in calibration automatically.

Figure 8:
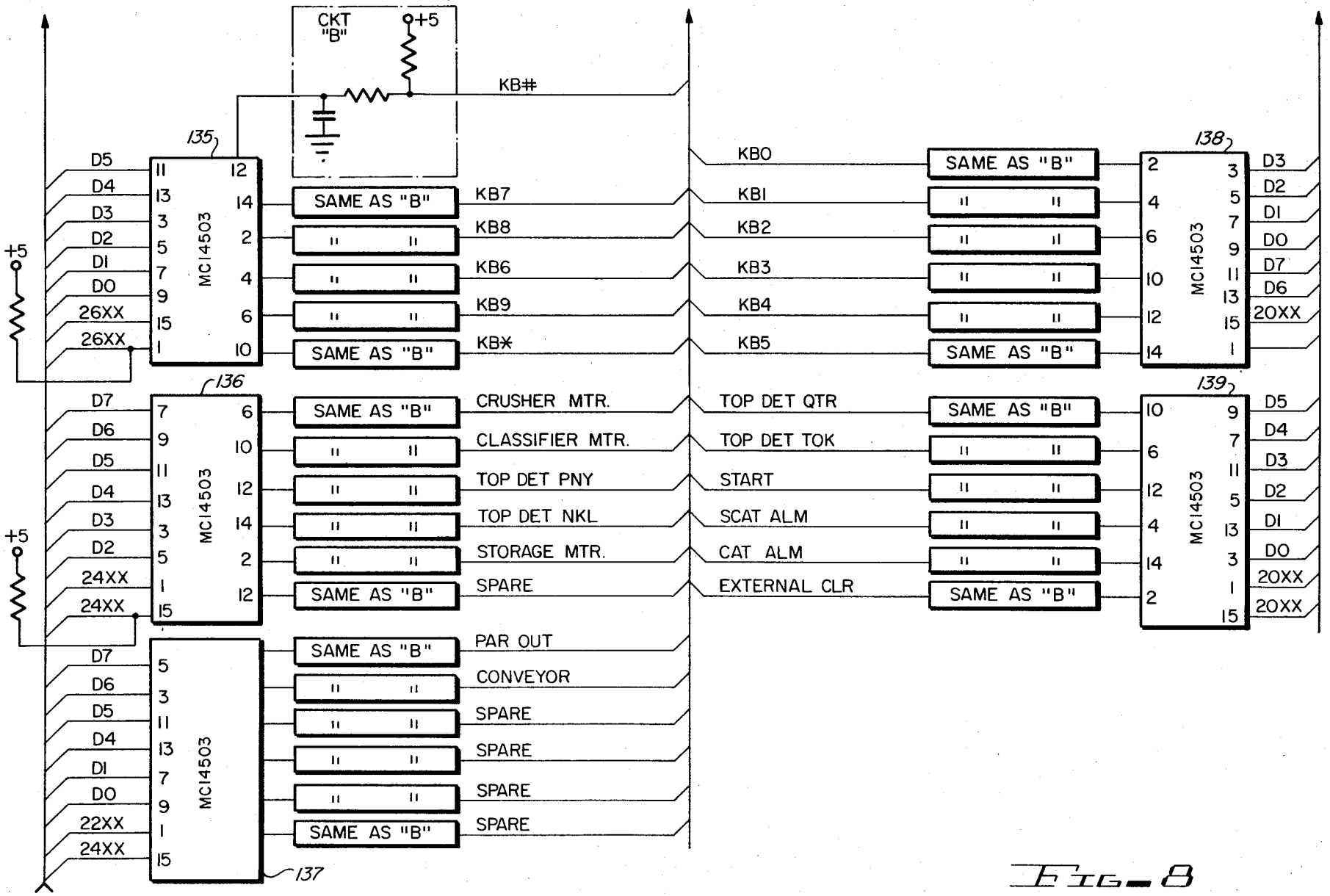
FIG. 8 is a schematic diagram of the input section of the master controller.

Input section 106 consists of input buffer devices 135 through 139 as shown in FIG. 8. These input buffer devices (e.g. MC 14503 tri-state buffers) respond only when addressed. The inputs are filtered to prevent noise from entering the system.

Figure 9:
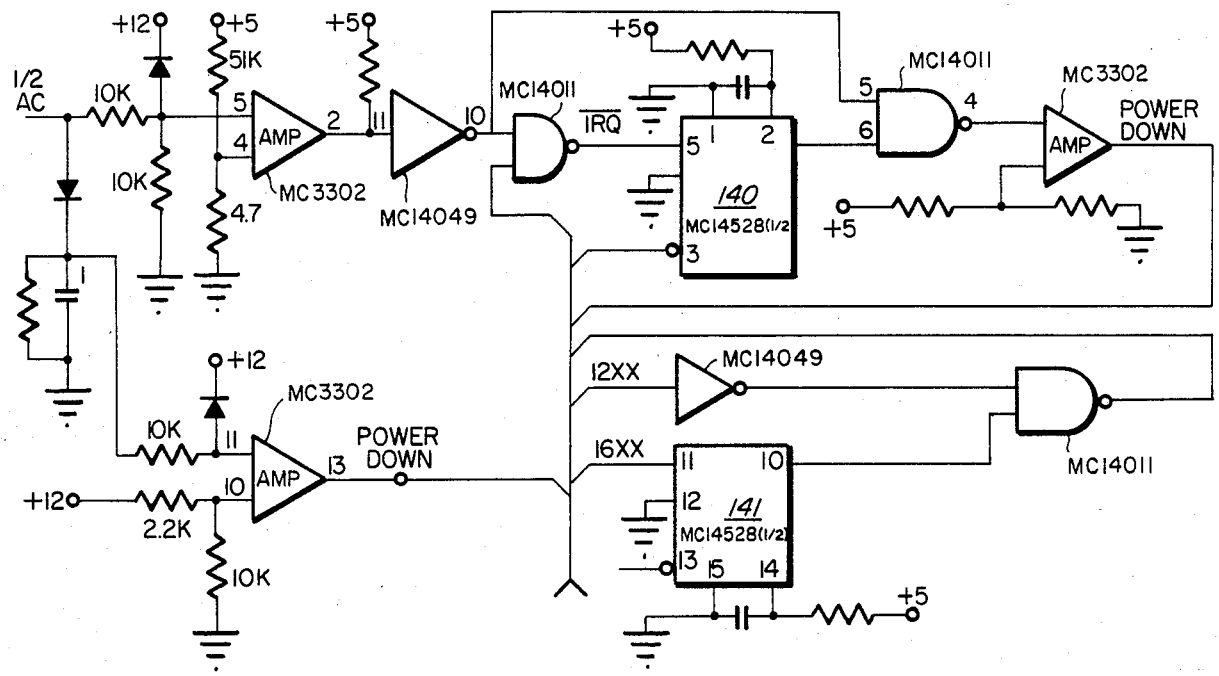
FIG. 9 is a schematic diagram of the interrupt, power down and memory enable section of the master controller.

Referring to FIG. 9, the interrupt, power down and memory enable section 101 contains a unique watch dog timer device 140 which uses a monostable multivibrator that is triggered on each interrupt and must be cleared by the processor when the interrupt routine is entered. Power down is detected when the input voltage goes below, for example, 90 VAC RMS at which time a signal is generated that causes the permanent memory to store its data in its own electrically alterable memory. A secure addressing method is used when data is to be placed in this permanent memory section 100. Only a narrow window is used to allow data in, and this window first addresses a monostable multivibrator device 141 before addressing the memory via another memory address.

Figures 10, 16:
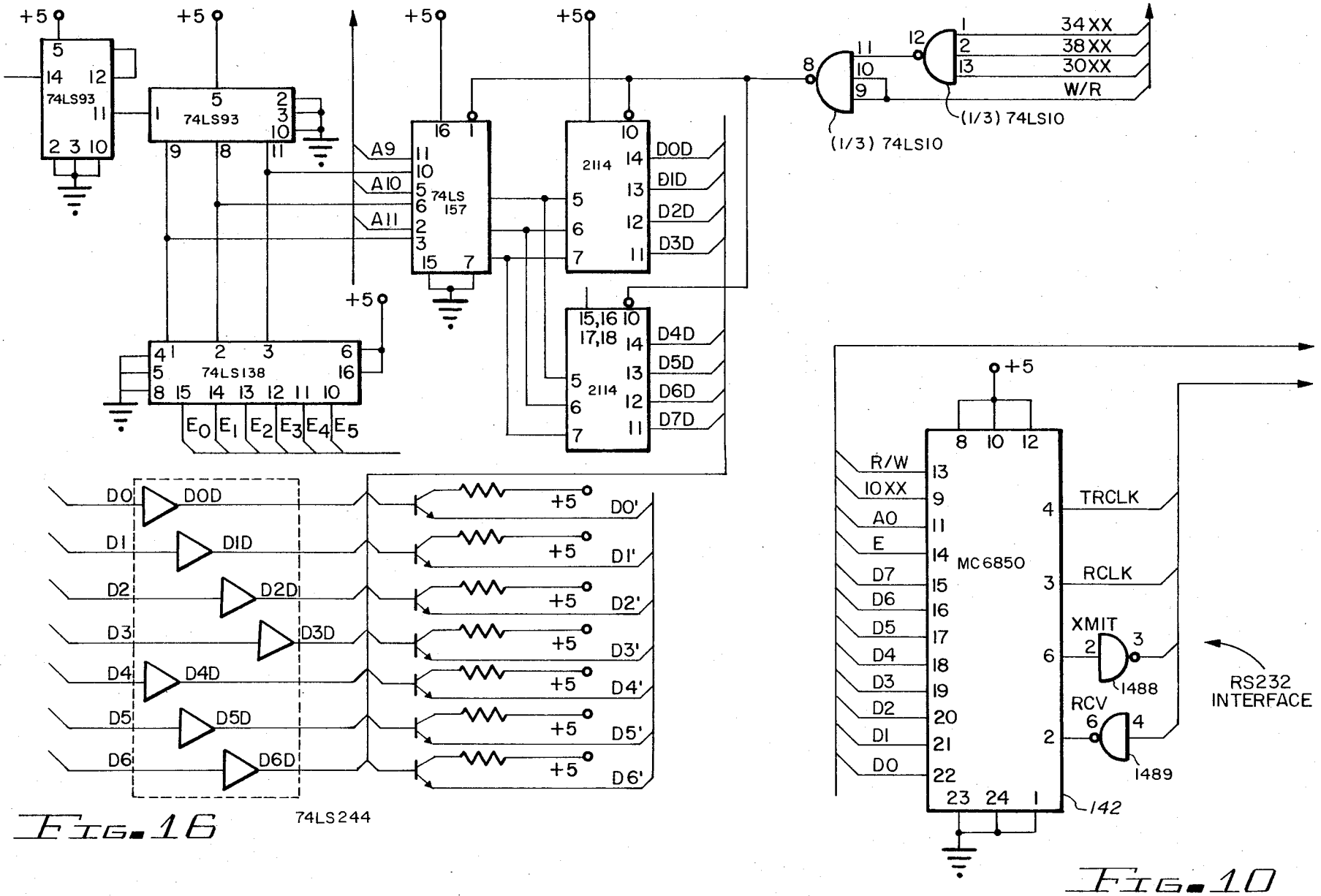
FIG. 10 is a schematic diagram of the communications interface section of the master controller.
FIG. 16 is a schematic diagram of the display driver and interface section of the master controller.

FIG. 10 illustrates the communication section 104. This section allows for serial communication with the controller 30 to provide all necessary signals to hook up to a telephone autodial or receive system, as well as to a data recorder etc. A parallel to series communication adapter (e.g. an MC 6850) 142 can be used to perform this function. The output of the communication interface 104 is compatible with an RS232 interface.

Figure 11:
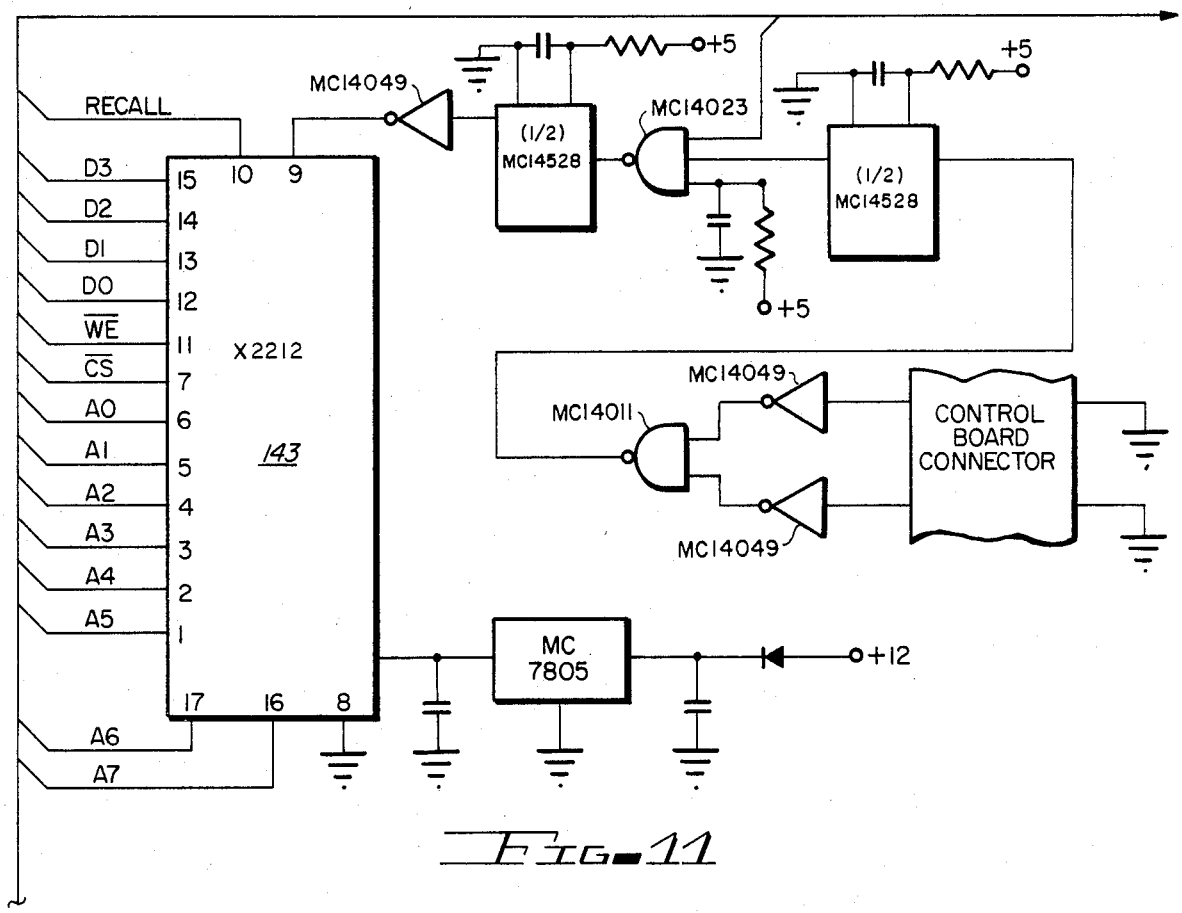
FIG. 11 is a schematic diagram of the permanent memory section of the master controller.

The schematic of the permanent memory section 100 in FIG. 11 illustrates how the RAM/PROM is used to provide permanent memory even when power has failed or is turned off. A XICOR (X2212) 64 X4 memory 143, for example is used. It consists of a random access memory (RAM) where data is normally stored. When a command to store occurs, the RAM is copied one for one into an electrically alterable read only memory where it remains permanently until the next store command.

Figure 12:
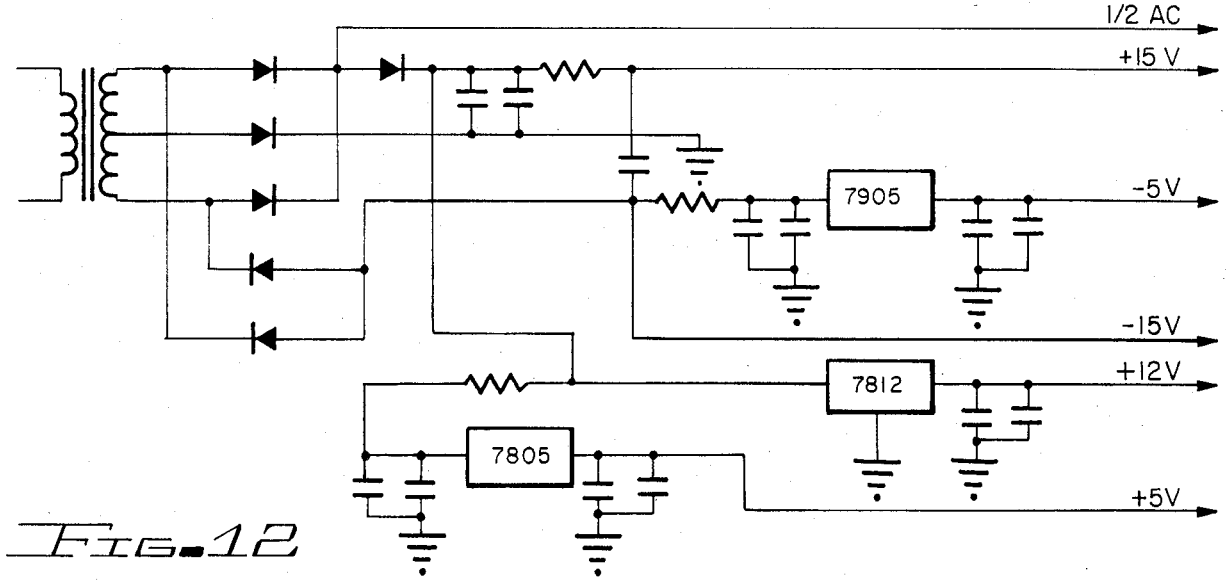
FIG. 12 is a schematic diagram of the power supply section of the master controller.

The power supply section 103 shown in FIG. 12 provides all of the voltage for the electronic hardware. It provides regulated plus 5 volts, plus 12 volts and minus 5 volts. It also supplies unregulated plus or minus 15 volts for driving the dispenser solenoids. The isolated $\frac{1}{2}$ AC is a full wave rectified unfiltered wave which provides interrupts every 8.33 milliseconds.

Figure 13:
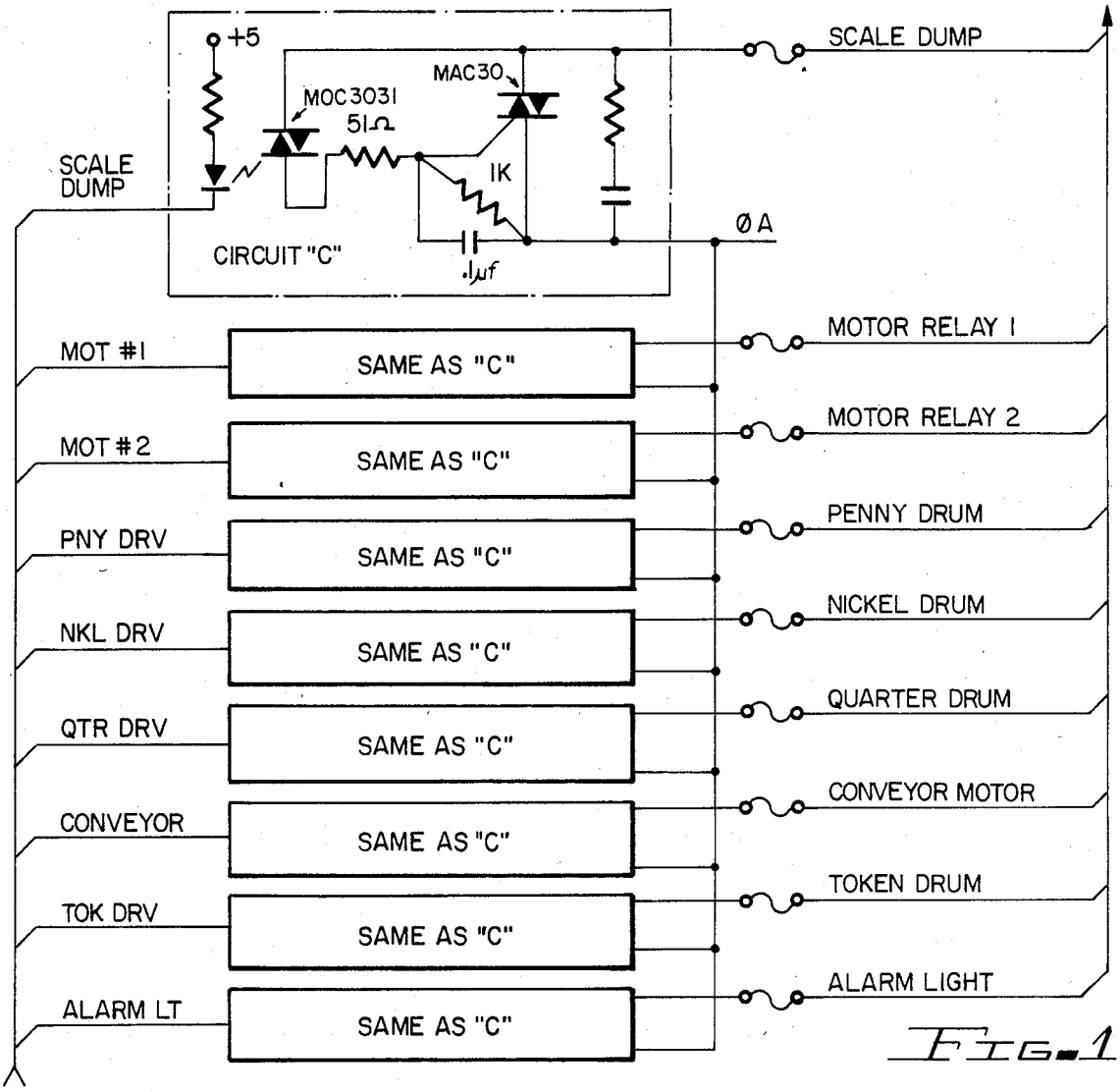
FIG. 13 is a schematic diagram of the logic to power driver section of the master controller.

Logic levels to power output is provided using specially designed solid state relays. These are shown in FIG. 13 which is a schematic of the logic to power driver section 113. Also employed is a zero crossing triac optical coupler combined with a 30 ampere triac. The outputs are fused to protect the triacs from being blown when shorted out.

Figure 14:
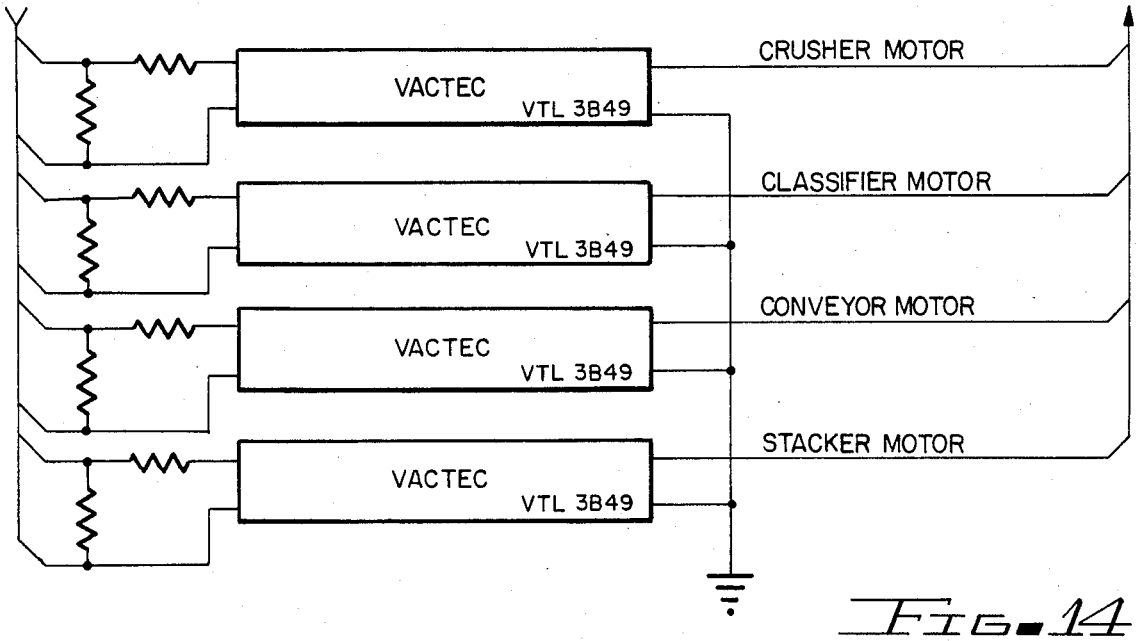
FIG. 14 is a schematic diagram of the motor operation detection section of the master controller.

FIG. 14 illustrates the motor operation detection section 108. It uses the VACTEC type device to directly detect AC using neon inputs. A photo-conducting cell is used to force the output low whenever the neon is on indicating that the motor is operating.

Figure 15:
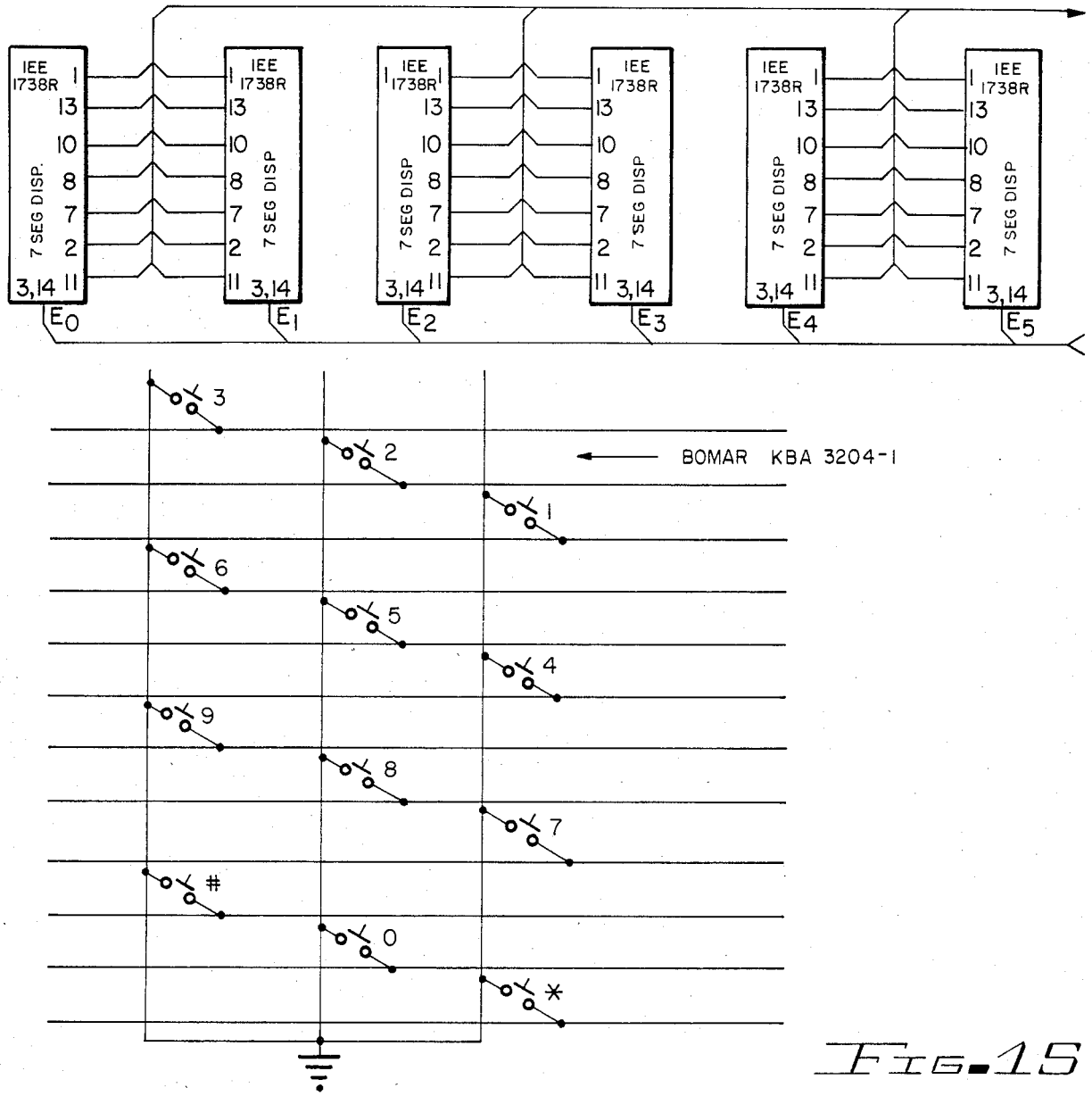
FIG. 15 is a schematic diagram of the keyboard and display section of the master controller.

FIG. 15 illustrates the keyboard and display section 107, and FIG. 16 illustrates the display drivers and interface section 102. These perform together to display the desired data commanded by the microprocessing unit 120. Seven segment light emmitting diodes are used as displays while the keyboard is a simple calculator type 10-digit keyboard.

Figure 18:
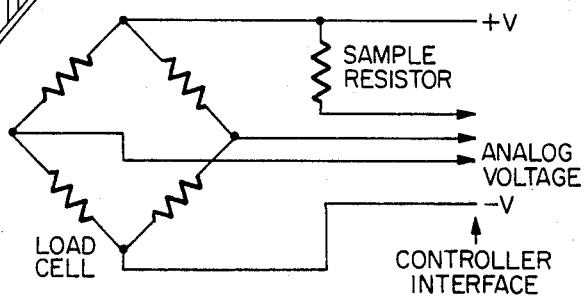
FIG. 18 is a schematic diagram of the load cell and sample resistor.

FIG. 18 is a schematic diagram of the load cell. It includes a sample resistor that allows for exact measurement of the weight of bucket 56 regardless of the controller used or the electronic hardware inside the controller. By using this technique, the load cells, controller, or the electronics are readily interchangeable while maintaining the same system accuracy.

FIGS. 19A and 19B illustrate the SCAT/CAT system used to detect classifier jams and to detect tin plated steel cans falling off the conveyor. The prior art arrangement was extremely sensitive to noise and had difficulty responding due to dust on the lens. In the circuit shown in FIG. 19A, the light emitting diode is pulsed producing substantial amounts of pulse power which is radiated to the light detector where it is again converted to an electrical pulse. A delayed sample is used to determine that the transmitted light signal is actually received. When the pulse is received, the output latch is set, or it is cleared by lack of data. During the time that the light is not being transmitted, the logic determines that the light input detector is on.

The above description is given by way of example only. Changes in form and details may be made by one skilled in the art without departing from the scope of the invention as defined by the appended claims:

What is claimed is:

1. In a collection apparatus for collecting scrap metal and for compensating depositors for a first type of metal as a function of the weight of the first type of metal deposited in a storage compartment of the apparatus, said apparatus having an input hopper, a start button, a first conveyor for conveying scrap metal from the hopper to a classifier, said classifier segregating a second type of metal from the first type, depositing the second type of metal in a metal receptacle and for depositing the first type of metal in a classifier conveyor, said classifier conveyor transporting the first type of metal to and loading said metal into a crusher, said crusher crushing the first type of metal and loading it into a weigher bucket of a weigher which measures the weight of the weigher bucket and its contents, said bucket having a door which is controlled by a scale dump solenoid for emptying the bucket after weighing, a stacker for conveying the first type of metal after it has been weighed to a storage compartment, an alarm display and means for producing motor alarms, second type metal alarms, classifier jam alarms and dispenser alarms, the improvement comprising:

a digital electronic controller responsive to a signal from the start button for energizing the first conveyor, the classifier, the crusher and the stacker, for calibrating the weigher, for weighing materials dumped in the bucket of the weigher, for monitoring the bucket to assure that the scale dump solenoid has opened the door thereto, for causing a reference voltage to be generated which represents a measure of exactly a given weight to be used in the weighing process, for dumping the materials from the hopper into the stacker for storage in the compartment, for dispensing compensation for the material weighed, and for stopping operation when there are is no more scrap metal to be processed;

a communication port for conveying and receiving remote information; and front panel display means for indicating the weight of said first type of metal deposited.

2. The collection apparatus of claim 1 wherein said controller includes permanent non-volatile memory means for controlling said compensation and the rate thereof.

3. The collection apparatus of claim 2 wherein said bucket is supported by three straps so as to improve weighing accuracy.

4. The collection apparatus of claim 3 wherein said controller includes short circuit protection means.

5. The collection apparatus of claim 4 wherein said first type of metal is aluminum.

6. The collection apparatus of claim 5 wherein said second type of metal is ferro-magnetic.

7. The collection apparatus of claim 6 wherein said controller includes a microprocessor.

8. The collection apparatus for collecting scrap metal of a given type and for compensating depositors of said scrap metal of said given type based on the weight of said scrap metal deposited, comprising:

first means adapted to receive scrap metal including metal of said given type;

classifier means for classifying and separating said scrap metal of a given type from other scrap metal, for depositing scrap metal which is not of said given type in a first receptacle and for depositing scrap metal of said given type into a classifier;

a first conveyor having a first conveyor motor for transporting scrap metal deposited in said first means to said classifier;

a crusher powered by a crusher motor for crushing scrap metal;

a classifier conveyor for transporting scrap metal of said given type to said crusher;

a weigher having a bucket for weighing material deposited in said bucket, said weigher being positioned so that material passing through the crusher is deposited in the bucket, said weigher including means for producing electrical signals which are a function of the weight of the bucket and of material placed in the bucket from the crusher;

means for dumping the contents of the bucket in response to a dump control signal to a scale dump solenoid operating a door of said bucket;

a storage compartment for said metal of said given type;

a stacker for conveying crushed metal of said given type when dumped from said bucket to the storage compartment for storage in said compartment;

a coin dispenser responsive to control signals for dispensing compensation to the depositor and for producing an alarm signal identifying the absence of the coins to be dispensed and a jam of the dispenser.

a front panel display means for informing said depositor of the weight of the metal of said given type deposited;

means for producing an alarm signal if any motors of the apparatus are energized and are not operating properly;

means for producing an alarm signal if metal is deposited in the first receptacle and if the first receptacle is full;

means for producing an alarm signal if the classifier conveyor is jammed;

control means for producing control signals for energizing the motors, for calibrating the weighing system, for dumping the bucket, for determining the weight of the given type of metal deposited in the storage compartment and the amount of compensation to be paid therefore, and for producing control signals to control the dispenser of compensation, said control means sensing any alarm signals produced and responsive to any such alarm signals for energizing the alarm and the out of order display for de-energizing the apparatus if the condition causing an alarm signal persists for more than a pre-determined period of time, for sequencing the operation of the motors, and for determining if the scale dump solenoid has been activated to empty the bucket; and communication means coupled to said control means for conveying and receiving remote information.

9. Collection apparatus according to claim 8 wherein said bucket is supported by three straps to improve weighing accuracy.

10. Collection apparatus according to claim 9 wherein said control means utilizes the weight of the bucket and its contents to determine if the scale dump solenoid has opened the door of the bucket.

11. Collection apparatus as defined in claim 10 wherein said control means includes permanent non-volatile memory means for controlling compensation and the rate thereof.

12. Collection apparatus as defined in claim 11 wherein said control means includes short circuit protection means.

13. Collection apparatus as defined in claim 12 wherein said control means causes a reference voltage to be generated which represents exactly a given weight.

14. Collection apparatus as defined in claim 13 wherein said scrap metal of said given type is aluminum.

15. Collection apparatus as defined in claim 14 wherein said scrap metal not of said given type is a ferro-magnetic material.

16. Collection apparatus as defined in claim 15 wherein said control means includes a microprocessor.

17. A method of controlling a collection apparatus which collects aluminum cans and for compensating a depositor thereof as a function of the weight of the aluminum cans deposited in a compartment of the apparatus, said apparatus having an input means, a start button, a first conveyor for conveying material from the input means to a classifier, said classifier segregating ferrous metal from non-ferrous metal, depositing ferrous metal in a ferrous metal receptacle and for depositing aluminum cans in a classifier conveyor; said classifier conveyor for transporting aluminum cans to a crusher and loading said cans into said crusher, said crusher for crushing the aluminum cans and loading crushed cans into a weigher bucket of a weighing apparatus which measures the weight of the bucket and the crushed aluminum cans in said bucket; a stacker for conveying the crushed aluminum cans after being weighed and dumping them into a storage compartment, the method comprising:

sensing when the start button is pushed;

energizing said first conveyor, classifier, crusher, and stacker;

calibrating said weigher;

determining the weight of materials dumped in the bucket of said weigher;

dispensing compensation based on the weight of aluminum cans in the bucket;

storing the compensation rate in a permanent nonvolatile memory means; and informing said depositor of the weight upon which compensation is based.

18. The method of claim 17 further comprising sequencing the operation of the various elements of said apparatus to reduce power consumed.

19. The method of claim 18 further comprising utilizing weight information to determine if the door of said bucket has opened.

20. The method of claim 19 further comprising generating a reference voltage which is equivalent to exactly a given weight which is then used in the weighing process.

21. The collection apparatus in accordance with claim 8 wherein said crusher having crusher control means for stopping said crusher during the period of time when said control means produce said control signals which determines the weight of the first type of metal and the amount of compensation to be paid therefore to improve the overall weighing accuracy by reducing any vibration by said crusher during the weighing operation to determine the compensation to be paid.

22. The collection apparatus in accordance with claim 8 including non-volatile memory means for permanently storing data representative of the accumulated weight of said first type of metal and the amount of money paid out in compensation prevent unauthorized tampering with the data payment records.

23. The collection apparatus in accordance with claim 8 including means for auto zero resetting each operation prior to the next weighing cycle to improve the accuracy of said collection apparatus.

24. The collection apparatus in accordance with claim 8 wherein timing means are provided to turn on each of the operations in a series sequence to reduce energy consumption and to prevent undesired peak power surges.

25. The method in acccordance with claim 20 wherein each of the steps are carried out automatically without operator assistance.

* * * * *